US005632380A

United States Patent [19]

Weick et al.

[11] Patent Number: 5,632,380

[45] Date of Patent: May 27, 1997

[54] FERROUS MATERIAL RECOVERY SYSTEM

[75] Inventors: Paul A. Weick; Samuel A. Keller, both of Silver Lake, Ohio

[73] Assignee: Shaneway, Inc., Akron, Ohio

[21] Appl. No.: 544,295

[22] Filed: Oct. 17, 1995

[51] Int. Cl.[6] ..... B03B 1/00

[52] U.S. Cl. ..... 209/7; 209/690; 209/930

[58] Field of Search ..... 209/7, 9, 12.1, 209/38, 40, 689, 690, 294, 299, 930

[56] References Cited

U.S. PATENT DOCUMENTS

| | | | |
|---|---|---|---|
| 395,621 | 1/1889 | Harrell | 209/299 X |
| 1,744,028 | 1/1930 | Borton | 209/299 X |
| 2,300,407 | 11/1942 | De Back | 209/299 X |
| 3,086,718 | 4/1963 | Lukas, Jr. . | |
| 3,650,396 | 3/1972 | Gillespie et al. . | |
| 3,802,631 | 4/1974 | Boyd . | |
| 3,885,744 | 5/1975 | Drage . | |
| 3,973,736 | 8/1976 | Nilsson . | |
| 4,020,992 | 5/1977 | Binger et al. . | |
| 4,044,956 | 8/1977 | Benedetto et al. . | |
| 4,116,822 | 9/1978 | Webb | 209/930 X |
| 4,178,238 | 12/1979 | Harris | 209/299 X |
| 4,337,900 | 7/1982 | Williams et al. . | |
| 4,341,353 | 7/1982 | Hamilton et al. . | |
| 4,815,667 | 3/1989 | Keller . | |
| 4,844,351 | 7/1989 | Holloway | 209/930 X |
| 5,390,799 | 2/1995 | Previero | 209/930 X |

FOREIGN PATENT DOCUMENTS

| | | | |
|---|---|---|---|
| 0220853 | 5/1987 | European Pat. Off. . | |
| 404322776A | 11/1992 | Japan | 209/690 |
| 2047575 | 12/1980 | United Kingdom | 209/299 |

*Primary Examiner*—D. Glenn Dayoan

*Attorney, Agent, or Firm*—Reed Smith Shaw & McClay

[57] ABSTRACT

A system for recovering ferrous metal components from waste materials includes a first magnetic separator for magnetically separating ferrous metal components from waste material and an impacting device for dislodging residual waste material from the surface of ferrous metal components separated by the first magnetic separator. The system may also include a second magnetic separator following the impacting device, a water washing system for cleaning ferrous metal components retained by the second magnetic separator, a ferrous metal collection station, a waste material collection station and conveyors for conveying the various unseparated and separated materials throughout the system. The impacting device includes a solid wall rotatable drum having at least one radially inwardly projecting protruberance on its interior surface. As the drum rotates, the protruberances lift the ferrous materials separated by the first magnetic separator. When the protruberances reach a sufficient elevation and angular orientation within the drum, the ferrous metal components and residual waste material clinging thereto drop under the influence of gravity and impact against the interior surface of the drum. The repeated impacts of the ferrous material with the interior surface of the drum effectively dislodges waste material from the surface of the ferrous metal components without comminuting the ferrous material or subjecting the drum to aggressive wear and tear.

18 Claims, 4 Drawing Sheets

FERROUS MATERIAL RECOVERY SYSTEM

FIELD OF THE INVENTION

The present invention relates in general to a system and method for recovery of salvageable materials from refuse and, more particularly, to a system and method for the recovery of ferrous metal components from incinerated waste materials.

BACKGROUND OF THE INVENTION

With the passage of time the volume and variety of solid waste products requiring disposal continually increases. In the past it was common practice to burn such waste products in open incinerators. However, because of comprehensive environmental regulation, incineration of solid waste has been restricted to a significant extent in many geographic areas and is prohibited in most urban areas.

Disposal of solid waste products in sanitary landfills has heretofore been a frequently used alternative disposal method. Presently, however, many existing landfills are reaching their capacity and additional clean landfills have not been approved by federal, state and local regulatory agencies due in part to existing environmental regulations and also because shortages of land in some geographic areas. Reemphasis has thus been placed upon incineration as a principal method of solid waste disposal. With that has come cleaner burning incinerators and a desire to recover, to the fullest extent possible, metals and other recyclable by-products of the incineration process.

Solid waste incineration produces large quantities of ash as a by-product. Although highly friable, ash possesses considerable adhesive and cohesive qualities. Consequently, ash tends to cling to the surface of ferrous metals and other salvageable materials and must be physically separated therefrom before those materials can be effectively recycled. Some techniques for ash removal have been rather crude, whereas others have been unduly complicated.

For instance, it has long been known to dislodge residual ash from the surface of salvageable waste products by percussive force. At its simplest, this is achieved by scooping a quantity of incinerated matter using the shovel or an electromagnet of a crane, bulldozer, front end loader or similar apparatus, raising the shovel or electromagnet to the desired elevation and then dropping the matter onto a hard surface. Many cycles of lifting and dropping are usually required before the recoverable materials are sufficiently "clean" to be recyclable. Additionally, this method is quite messy, as well as time and labor intensive.

It has also been proposed to drop quantities of incineration by-products against an inclined screen, grate or the like. In so doing, friable material such as ash is caused to fall through the openings in the screen and salvageable material of a predetermined particle size is caused to roll off the screen, whereby it may be recovered. This method, although somewhat more sophisticated, suffers from the same disadvantages encountered when simply dropping matter against a hard surface. Moreover, screens quickly tend to clog thereby reducing their effectiveness. Conversely, even an unclogged screen performing at optimum efficiency is undesirable because a considerable fraction of valuable salvageable material falls through the screen's openings and is unintentionally discarded.

Others have used trommels, which are simply rotating cylindrical screens, as means to extract ash from salvageable matter. Some trommels are internally equipped with means for agitating the waste material during trommel rotation. Being screens, however, trommels clog and also waste salvageable material. An example of a trommel separator is disclosed in U.S. Pat. No. 4,020,992.

U.S. Pat. Nos. 3,086,718, 3,650,396, 3,885,744, 3,973,736, 4,044,956, 4,341,353 and 4,815,667, as well as published European Patent Specification 0 220 853 describe recovery systems including mill-type crushing and grinding devices for comminuting the waste products to reduce the size of the products, oftentimes both the salvageable and non-salvageable materials, as well as several stations at which the comminuted products are separated by size. Although generally effective for their intended purposes, such apparatus require frequent maintenance. In particular, they encounter little resistance in crushing malleable materials including non-ferrous metals such as aluminum and the like and friable materials such as ash. However, hard, crush-resistant materials such as ferrous metals tend to cause frequent jams and premature wear of the grinding elements. Moreover, consumers of recovered ferrous metals, typically steel mills, are generally not concerned that the raw ferrous metals be reduced to small and/or uniformly sized fragments. Little need exists, therefore, to comminute ferrous metal products or to separate such products according to size. The most important consideration is that the ferrous metal products that are recovered be "clean," i.e., essentially uncontaminated by nonmetallic waste products and ash.

U.S. Pat. No. 4,337,900 describes a system for recovering aluminum from unincinerated waste. The system includes a preliminary magnetic separator and a final magnetic separator. The preliminary magnetic separator removes a certain fraction of ferrous metals from a stream of waste material but is not supplemented by any means for removing matter that may cling to the surface of the ferrous metals. As such, ferrous metals recovered by the preliminary magnetic separator are generally not sufficiently clean to enable an end user to recycle the ferrous materials without first performing additional time, labor and energy consuming procedures to separate the residual waste matter from the ferrous metals. The final magnetic separator follows a hammer ring rotor where ferrous metal and other components of the waste stream are comminuted. As with the systems discussed immediately hereabove, such comminution of the hard ferrous metal components tends to shorten the useful service life of the comminuting equipment.

U.S. Pat. No. 3,802,631 discloses a raw refuse material separating and recycling system that employs a complex arrangement of material separation stations. The first of these stations employs a slurry drum separator. The slurry drum is a rapidly rotatable trommel connected to a supply of water whereby water is injected into the drum to form a slurry of refuse which, during rotation of the drum, is forced outwardly by centrifugal force to pass through one or more screens in the annular side wall of the trommel. The drum separator thus initially separates the refuse into soluble and insoluble materials. The slurry drum separator consumes considerable quantities water in order in order to separate the soluble from the insoluble matter. In addition, it does not separate ferrous materials from the balance of the refuse stream. This occurs at a magnetic separator located several stations downstream of the slurry drum. If conceivably adapted to an incinerated waste products salvaging environment, the apparatus disclosed in U.S. Pat. No. 3,802,631 would be unnecessarily complex and resource intensive. Moreover, it would constitute an inefficient and unduly expensive system for one seeking an economical way to separate ferrous metals from other incinerated waste by-products.

A need exists, therefore, for an uncomplicated system that will permit cost-effective recovery of ferrous metal components from friable, incinerated waste materials including carbonaceous incineration by-products such as ash. Such a system should enable efficient recovery of clean salvageable ferrous metal components from the incinerated waste materials without comminution of the ferrous metal components and without using supplemental resources such as water as a separating agent.

SUMMARY OF THE INVENTION

The present invention provides a system including an apparatus and method for recovering salvageable ferrous and non-ferrous materials from incinerated waste materials including friable, carbonaceous incineration by-products such as ash.

More particularly, the present invention is directed to a system for recovering salvageable ferrous and non-ferrous metal from a source of feed material. The feed material processed in the recovery system generally consists of the bottoms or ash material remaining after incineration of waste materials, e.g., the bottoms or ash produced in a furnace in a mass burning operation used to generate electricity or steam. The bottoms product generally includes incinerated carbonaceous by-products, such as ash, and associated incinerated ferrous and non-ferrous metal components such as aluminum, copper, nickel and brass. The bottoms product may also include glass, ceramics and other refuse typically contained in municipal refuse that are not completely incinerated at the furnace incineration temperature. Although incinerated waste materials are the preferred feed stock of the invention, other feed materials, including ash and ash-related products and non-ferrous and/or ferrous metal components, are also suitable.

The system may include an optional preliminary separating means such as a grizzly or similar device for separating very large sized fractions from the balance of an incoming supply of feed material. The feed material that passes the preliminary separating means is then delivered by a first conveying means to a first separating means. The first separating means preferably comprises a magnetic separator for extracting ferrous material from the stream of feed material delivered by the first conveying means.

The ferrous material retained by the first separating means is then delivered to a non-destructive impacting means. The impacting means preferably comprises a solid-walled, slowly rotating and slightly inclined drum having at least one protruberance such a vane or similar lifting means on its interior surface. Ferrous material and any waste products clinging thereto enter the impacting means and are lifted by the lifting means as the drum rotates. When the lifting means reaches a sufficient elevation and angular orientation during rotation of the drum, the ferrous material and the residual waste products drop under the influence of gravity and impact against the interior surface of the drum. This lifting and dropping process proceeds continuously as the feed material traverses the length of the drum. The repeated impacts of the feed material with the inner wall of the drum function to effectively dislodge the ash and other waste products from the ferrous material without comminuting the ferrous material or subjecting the drum to aggressive wear and tear.

Upon discharge from the impacting means, the ferrous metals, loose ash and other components of the feed material are delivered by a second conveying means to a second separating means. The second separating means preferably comprises a magnetic separator substantially similar in construction and function to the first separating means. Ferrous material retained by the second separating means may then be delivered to a third conveying means. The third conveying means preferably comprises a vibrating conveyor or, more preferably, a vibrating conveyor equipped with a high pressure water washing system. Unlike the slurry drum separator of U.S. Pat. No. 3,802,631, the water washing system of the third conveying means is not used to free salvageable products from other matter contained in a stream of feed material. In the instant system that function is performed by the aforesaid impacting means. Rather, the high pressure washing system merely removes any incidental and typically inconsequential quantities of ash particles remaining on the surface of the ferrous metals recovered by the second separating means. Moreover, the washing system effectively removes remaining ash using very little water as opposed to the large volumes necessarily required by the material separating slurry drum described in U.S. Pat. No. 3,802,631.

The third conveying means delivers the cleaned ferrous material to a ferrous material collection station at which ferrous material may be amassed for delivery to an end user such as a steel mill.

Simultaneously, non-ferrous metals, ash and other matter not retained by the first and second separating means may fall from the discharge ends of the first and second conveying means and be delivered by suitable conveying means to appropriate collection stations from which the waste products may be extracted for further processing and/or disposal.

In this regard, the system may also optionally include screens and crushing means disposed to receive the discharge from the first conveying means and arranged substantially in the manner described in U.S. Pat. No. 4,815,667. Such equipment may be used to preliminarily process and recover non-ferrous metals whereby the non-ferrous metals may be more efficiently recycled at a non-ferrous metal salvaging facility.

The low-maintenance recovery system of the present invention thus effectively and economically separates ferrous materials from ash and other matter from a stream of waste product feed material. It achieves these mutually beneficial objectives by avoiding destructive comminution of the feed material through deployment of a novel impacting means. Further, it eliminates needless size segregation of the ferrous materials and reliance upon water or other supplemental resources as separating agents during the recovery process.

Other details, objects and advantages of the present invention will become apparent as the following description of the presently preferred embodiments and presently preferred methods of practicing the invention proceeds.

BRIEF DESCRIPTION OF THE DRAWINGS

The invention will become more readily apparent from the following description of preferred embodiments thereof shown, by way of example only, in the accompanying drawings wherein.

DETAILED DESCRIPTION OF THE INVENTION

The ferrous materials recovery system of the present invention offers a reliable and efficient method and apparatus for recovering salvageable ferrous metals from a supply of waste product feed material. The processed feed materials typically include the bottoms remaining after incineration of the waste products such as in electricity generation plants that burn municipal waste. Following incineration, such waste may consist of incinerated, friable carbonaceous by-products such as ash, non-ferrous metal components, ceramics, glass and, most significantly with regard to the present invention, ferrous metal components.

Figure 1:
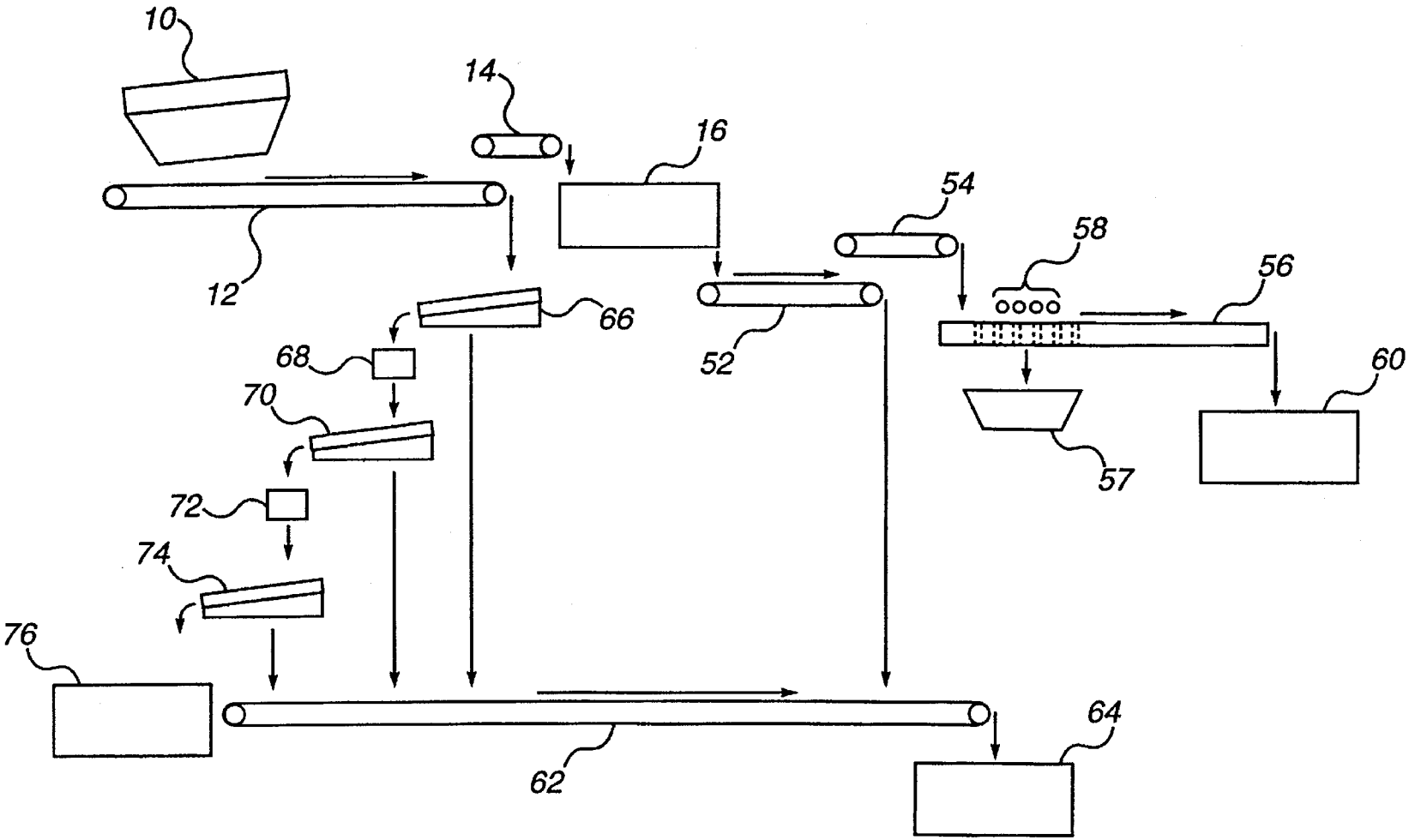
FIG. 1 is a process schematic diagram of a presently preferred embodiment of the recovery system of the present invention.
Figure 2:
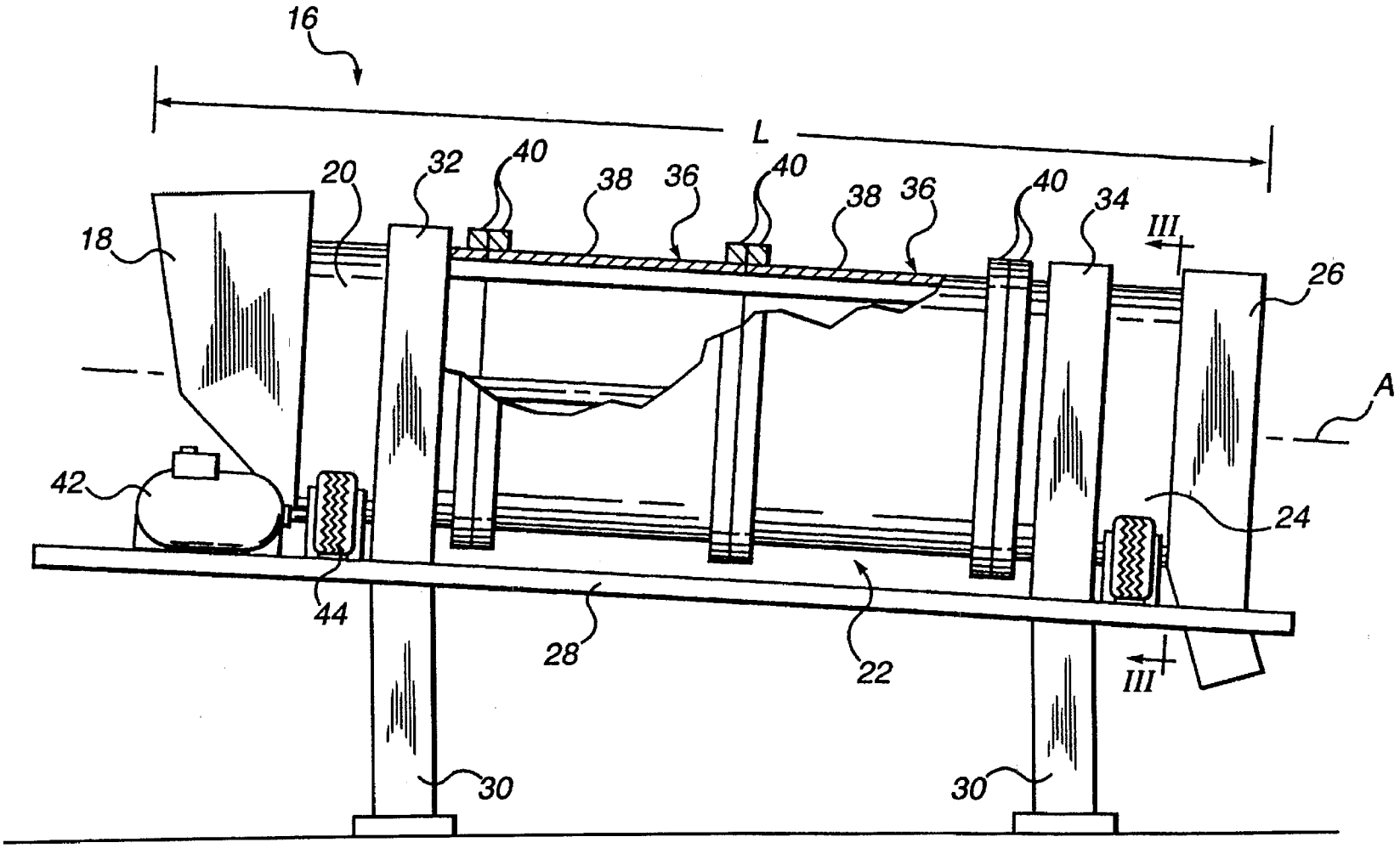
FIG. 2 is a partially cut-away side elevation view of a presently preferred embodiment of a rotary impacting means adapted for use in the recovery system of the present invention.
Figure 3:
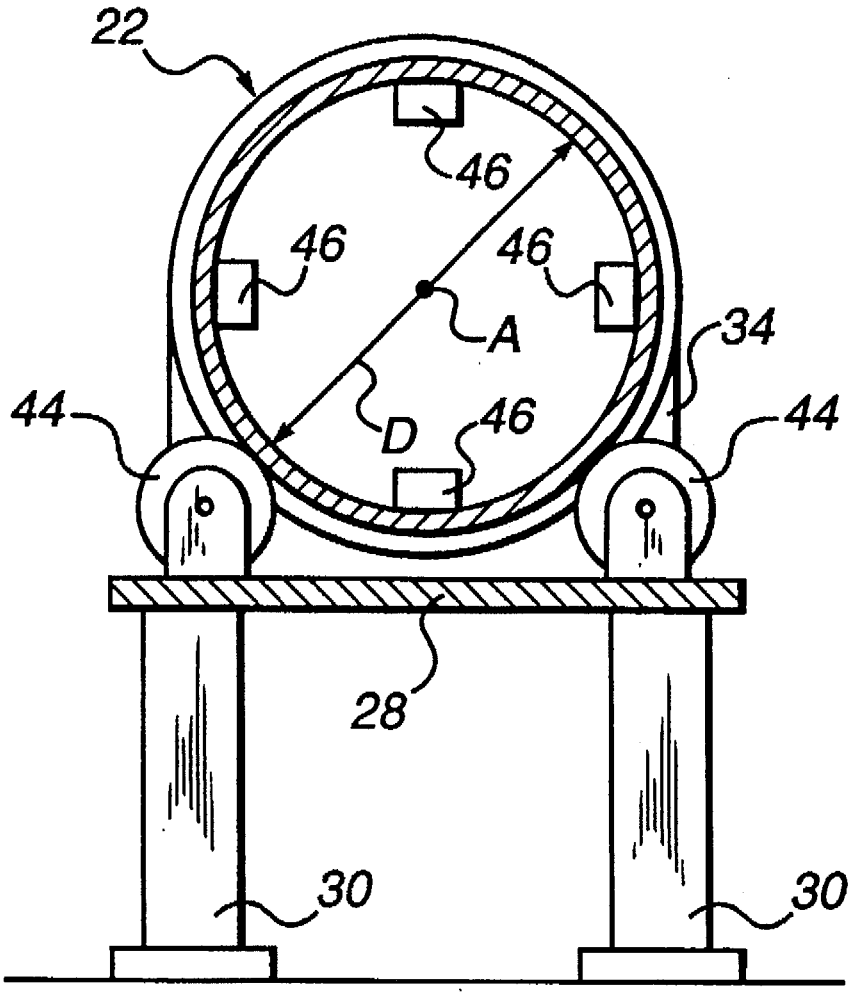
FIG. 3 is a cross-sectioned view of the rotary impacting means taken along line III—III of FIG. 2.

Referring to FIG. 1, the recovery system according to the invention preferably, although not necessarily, includes a preliminary separating means 10 such as a grizzly or similar device for separating very large sized fractions (generally greater than about 12 inches) from the balance of an incoming supply of feed material. The feed material that passes the preliminary separating means 10, or all of the feed material stream if no preliminary separating means is deployed, is delivered by a first conveying means 12 to a first separating means 14. The first conveying means 12, and any or all of the conveying means discussed hereinafter, may assume the form of any suitable material conveying device. For instance, except where otherwise indicated, the several conveying means may comprise belt conveyors disposed horizontally or, more preferably, inclined at an angle with respect to horizontal.

The first separating means 14 is a magnetic separator of any suitable construction. According to a presently preferred embodiment, the first separating means 14 may be a conventional belt magnet. The first separating means functions to remove ferrous pieces such as iron and steel from the stream of feed material.

The ferrous material retained by the first separating means 14 is then delivered to a non-destructive impacting means 16, the details of which are most clearly illustrated in FIGS. 2 through 5. Turning to those figures, it will be seen that the impacting means preferably includes an upwardly open intake chute 18 having an opening of sufficient size to accommodate any material that may be processed by the system. Intake chute 18 is connected to an upstream inlet 20 of a rotatable drum 22 whereby the drum may rotate about its longitudinal axis of symmetry "A" relative to the intake chute. The opposite end of the drum likewise defines a downstream outlet 24 connected for relative rotation with respect to a downwardly open discharge chute 26. The impacting means 16 further preferably includes an elongated table 28 which itself may be supported by means 30 such as a plurality of columns. Arranged atop the table 28 are bearing means 32 and 34. The bearing means 32, 34 function much like enlarged pillow blocks for allowing stable and substantially frictionless rotation of the drum 22 during operation of the impacting means 16. The intake chute 18 and discharge chute 26 may prevented from rotation by any appropriate means. For example, intake chute 18 may be affixed to table 28 by an illustrated rigid structural support. The discharge chute may be similarly attached to the table or, as illustrated, its open mouth may project downwardly from a suitable opening provided in the table.

The drum 22 may comprise, depending upon the desired waste material throughput requirements of the recovery system, one or more drum sections 36. Each drum section 36 is preferably constructed as a substantially cylindrical member having a solid, imperforate annular side wall 38 with radially directed attachment flanges 40 at opposite ends thereof. Likewise, the upstream inlet 20 and the downstream outlet 24 of drum 22 are also preferably cylindrical in shape and carry radially projecting attachment flanges 40. So constructed, when maintenance or replacement of the drum section(s) 36 is desired or necessary, one or more of the drum sections may be readily detached from and connected to another drum section, the inlet 20 and/or the outlet 24 by conventional fastening means such as unillustrated clamps or nut and bolt assemblies operatively associated with the abutting attachment flanges 40.

Although not illustrated, it is also alternatively contemplated that rather than constructed as one or more drum sections 36 disposed end-to-end, drum 22 may be formed as a single elongated drum having a plurality of interchangeable wall sections. So configured, the drum would be provided with two or more longitudinally arranged, partially or semi-cylindrically shaped wall sections detachably connected to one another by longitudinally extending flanges and suitable fastening means. In such case, one or more drum wall portions spanning, for example, 90°, 120° or 180° of arc about the longitudinal axis of symmetry A may be readily replaced if drum maintenance is deemed necessary.

The drum 22 may be rotated by any suitable drive means 42 such as an electric, pneumatic or hydraulic motor which may be a constant or, more preferably, a variable speed drive. The output of the drive means 42 may rotatably drive the drum via any conventional power transmission mechanism such as a chain, belt or gear train. According to a presently preferred embodiment, however, the drum is driven by way of a friction wheel drive. That is, one of several wheels 44 is connected to the output of the drive means 42 so as to be rotatably driven thereby. The perimeter of the drive wheel is in frictional contact with the outer surface of the drum, most preferably with either the inlet 20 (as illustrated) or outlet 24. The remainder of the wheels 44, which are preferably arranged in pairs at opposite ends of the drum, act as idler rollers to facilitate smooth rotation of the drum. To prevent friction reducing contamination of the drive wheels 44, the circumferences thereof are preferably continuously cleaned with unillustrated wipers. Furthermore, the table 28 may support one or more thrust rollers (not illustrated) situated at either or both ends of the drum to further enhance stable rotation during operation.

An exemplary construction of drum 22 is as follows. The drum may comprise two drum sections 36 whose annular sidewalls may be fabricated AR230 steel plate of ⅜ inch minimum thickness. The inner diameter D of the drum is preferably about 6 feet to assure adequate vertical drop of ferrous metals impacted within the drum as will be described in greater detail in connection with FIGS. 4 and 5. The length L of the impacting means 16 from intake chute 18 to discharge chute 26 (FIG. 2) is preferably about 10 to 20 feet. In addition, the drum must be provided with a gentle slope of about 3° to 5° whereby gravity may urge ferrous material to traverse the length of the drum during rotation. With a drum so constructed and driven at a rotational speed of between about 6 and 10 rpm, a typical residence time of ferrous material within the drum can be expected to range from about 10 to about 30 seconds at a typical flow rate of ferrous material of about 10 tons/hour.

It Will be understood that the foregoing dimensions and other physical and operational criteria are merely illustrative and not limitative. For instance, length L may range from about 6 to about 25 feet, diameter D from about 4 to about 8 feet, slope from about 2° to about 5°, and rotational speed from about 3 to about 15 rpm. Even these ranges may be greater or less than herein stated and it will be appreciated that selection of a certain value for drum length, diameter, slope, etc. influences the values chosen for the other parameters. Furthermore, there may be as few as one, or more than two drum sections 36 as may be necessary to effectuate desired performance within certain practical constraints including system fabrication costs and available plant space.

The drum 22 of impacting means 16 further comprises at least one or, more preferably, a plurality of protruberances 46 provided on the interior surface thereof. Preferably, each drum section 36 carries such protruberances which may assume any suitable configuration sufficient to achieve the functional characteristics described hereinbelow. By way of example, protruberances 46 may be constructed from steel members such as angle iron, box beams, channels or the like. They may be welded, bolted or otherwise fixedly secured to the interior surfaces of the drum sections so as to project radially inwardly, e.g., from about 1 to about 6 inches, to thereby act as vanes for continuously lifting and dropping ferrous material during rotation of the drum. The protruberances may be continuous or discontinuous, as well as staggered in relation to one another and/or in relation to those of contiguous drum sections. They may be parallel or angled with respect to one another and they may be straight or helically arranged along the length of the drum 22. According to a presently preferred embodiment, the protruberances 46 comprise a plurality of continuous, elongated members extending substantially parallel to one another and to the longitudinal axis A of the drum 22 for substantially the entire length thereof. In some circumstances, it may be desirable to space the protuberances a certain distance from the intake end of the drum if necessary to prevent material jams at the inlet, e.g., for the first 2 to 3 feet downstream of the intake chute 18. If more than one protruberance is provided, such protruberances are preferably equiangularly spaced about the interior of the drum, as illustrated.

Figure 4:
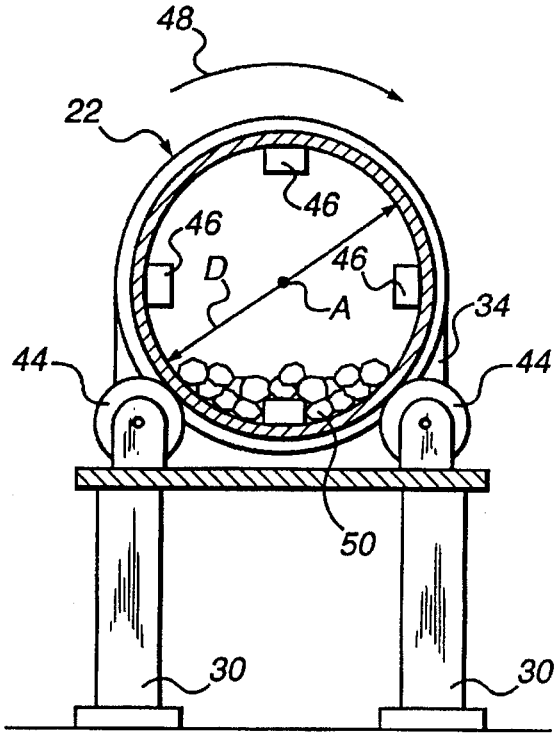
FIG. 4 is a view similar to FIG. 3 of the rotary impacting means as typically disposed at a first instant in time.
Figure 5:
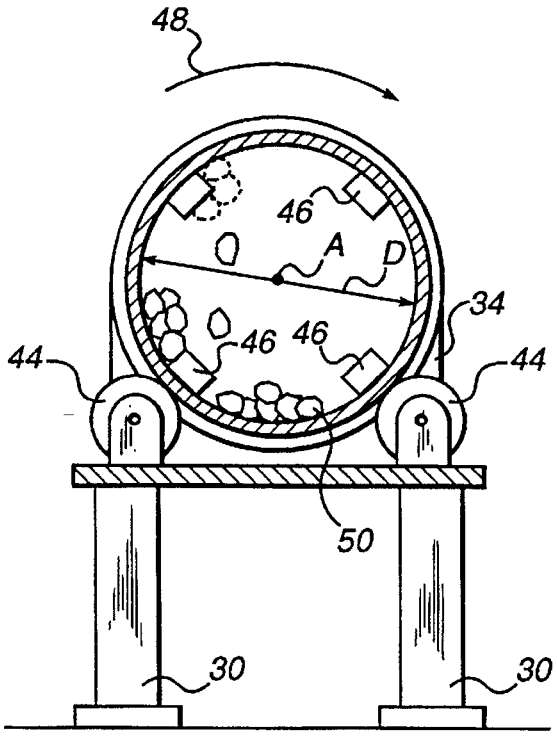
FIG. 5 is a view similar to FIG. 4 of the rotary impacting means as typically disposed at a later instant in time.

FIGS. 4 and 5 depict two moments in time occurring during the continuous rotation of drum 22. These figures graphically reveal the principle by which impacting means 16 non-destructively separates ferrous metal components from incinerated ash and other materials that may be adhered thereto.

Referring initially to FIG. 4, drum 22 is illustrated as being rotatable in a clockwise direction as represented by arrow 48. It will be appreciated that the drum may also be rotated counterclockwise. As the drum rotates, the protruberance(s) 46 sequentially sweep downwardly and laterally engage a stream of feed material 50 delivered along the lowermost regions of the continuously moving drum. Upon contacting the feed material, the protruberance(s) proceed to lift the material. When the protruberance(s) reach a sufficient elevation and angular orientation during rotation of the drum, the material falls under the influence of gravity from the dotted line position shown on FIG. 5 whereupon it impacts against the interior surface of the rotating drum. The lifting and dropping process proceeds continuously as the feed material traverses the length of the drum. The repeated impacts of the feed material with the inner wall of the drum generates sufficient percussive force to effectively dislodge residual ash and other waste material from the surface of the ferrous material. Additionally, since the hard ferrous material is not actively comminuted, the impacting means 16 avoids the aggressive wear and tear that conventional ferrous material crushing or grinding means typically experience during routine operation. As a consequence, the impacting means 16 may operate for significantly longer periods between maintenance episodes than ferrous metal comminuting devices heretofore known in the art. Furthermore, when maintenance does become necessary, the ease by which it may be performed is enhanced by the construction of drum 22 which permits as many drum sections 36 as may need service to be quickly removed, repaired and reinstalled or, alternatively, replaced by new or rebuilt drum sections.

Referring again to FIG. 1, the stream of ferrous metals, ash and other matter exiting the impacting means 16 falls through discharge chute 26 onto a second conveying means 52 which delivers the material to a second separating means 54. The second separating means is a magnetic separator which may be of the same or similar type to that of the first separating means 14. Ferrous material retained by the second separating means is delivered to a third conveying means 56. The third conveying means preferably comprises an inclined vibrating table equipped with a high pressure water washing system 58. The water washing system, which is an optional feature, removes incidental and typically inconsequential quantities of ash particles remaining on the surface of the ferrous metal. The vibrating table of the third conveying means 56, if equipped with the aforesaid water washing system 58, is preferably perforated so as to permit drainage of water from the surface of the ferrous metals conveyed thereby. Water and ash passed by the vibrating table is captured by a recovery basin 57 from which it may be delivered to a settling tank or other separating equipment whereby the water may be separated from the ash and recycled to be used as feed water for the water washing system 56.

The third conveying means 56 then delivers the essentially clean ferrous material to a ferrous material collection station 60. Ferrous material may thus be amassed at station 60 to await delivery to an end user such as a steel mill.

Concurrently, non-ferrous metals, ash and other matter not retained by the first and second magnetic separating means 14, 54 may fall by gravity from the discharge ends of the first and second conveying means 12, 52. Matter discharged by the first conveying means may thus be directly delivered by a fourth conveying means 62 to an ash collection station 64 from which ash and other waste products may be extracted for further processing and/or disposal.

In addition, the recovery system of the present invention may also comprise optional screens and crushing means disposed between the discharge end of the first conveying means 12 and the fourth conveying means 62. A presently preferred arrangement is one configured substantially as described in U.S. Pat. No. 4,815,667, the disclosure of which is incorporated herein by reference. More particularly, the system may include a first inclined vibrating screen 66 having openings appropriately sized to permit passage of waste products of about one inch or less in size to the fourth conveying means. Because of the fine-mesh nature of the first screen 66, the waste material it passes is predominantly composed of ash. As such, inadvertent discarding of non-ferrous metals and other salvageable materials is minimized. Oversized material retained by the first screen is directed to a first crushing means 68 for reducing the particle size of the material. The crushed material exiting the first crushing means passes to a second inclined vibrating screen 70 having openings corresponding substantially in size to the first screen 66. Waste material passing the second screen 70 falls to the fourth conveying means 62 whereas oversize particles are delivered to a second crushing means 72 for further size reduction. A third inclined vibratory screen 74 desirably receives the discharge from the second crushing means 72. Again, third screen 74 has openings sized to pass ash and other fine particulate waste material. The material retained by the third screen is in turn directed to a residual salvageable material collection station 76, which station serves in typical applications as a non-ferrous metal collection site. Screens 66, 70 and 74 as well as crushing means 68, 72 thus advantageously function as means for preliminarily processing non-ferrous materials such that those materials may be more efficiently recovered at a non-ferrous metal salvaging facility.

Although the invention has been described in detail for the purpose of illustration, it is to be understood that such detail is solely for that purpose and that variations can be made therein by those skilled in the art without departing from the spirit and scope of the invention except as it may be limited by the claims.

What is claimed is:

1. A system for recovering ferrous material from waste materials, said system comprising:

first magnetic separating means for separating ferrous metal components from said waste material; and impacting means for dislodging residual waste material from the surface of ferrous metal components separated by said first magnetic means without comminuting said ferrous metal components, said impacting means comprising a solid wall rotatable drum and means for rotating said drum, said rotatable drum including means for lifting and dropping said ferrous metal components during rotation of said drum such that said ferrous metal components impact against an interior surface of said drum to dislodge residual waste material from the surface of said ferrous metal components.

2. The system of claim 1 further comprising second magnetic separating means for separating ferrous metal components from waste material dislodged from said ferrous metal components by said impacting means.

3. The system of claim 1 further comprising means for cleaning the surface of said ferrous metal components following dislodgment of said waste material.

4. The system of claim 1 further comprising first conveying means for conveying waste materials to said first magnetic separating means.

5. The system of claim 4 further comprising means disposed in advance of said first conveying means for separating said waste materials according to size.

6. The system of claim 1 further comprising a ferrous metal collection station for collecting ferrous metal components separated from said waste material.

7. The system of claim 1 further comprising a waste material collection station for collecting waste material from which ferrous metal components have been separated.

8. The system of claim 1 wherein said means for lifting and dropping said ferrous metal components comprise at least one protruberance provided on said interior surface.

9. The system of claim 8 said at least one protruberance comprises a plurality of protruberances.

10. The system of claim 8 wherein said at least one protruberance comprises at least one elongated member projecting radially inwardly from said interior surface.

11. The system of claim 10 wherein said at least one elongated member extends substantially parallel to a longitudinal axis of symmetry of said drum.

12. The system of claim 11 wherein said at least one elongated member extends substantially the entire length of said drum.

13. The system of claim 12 wherein said at least one elongated member is spaced from an intake end of said drum.

14. The system of claim 1 wherein said drum comprises at least one detachable drum section.

15. The system of claim 8 wherein said drum comprises at least one detachable drum section, said at least one protruberance being provided on said at least one detachable drum section.

16. A method for recovering ferrous material from waste materials, said method comprising the steps of:

(a) separating ferrous metal components from waste material using a first magnetic separating means; and (b) dislodging residual waste material from the surface of ferrous metal components separated in step (a) without comminuting said ferrous metal components using an impacting means comprising a rotatable solid wall drum, said drum operating to lift and drop said ferrous metal components during rotation of said drum such that said ferrous metal components impact against an interior surface of said drum and said residual waste material dislodges from said ferrous metal components responsive to said impact.

17. The method of claim 16 wherein said impacting means further comprise at least one protruberance provided on said interior surface, said at least one protruberance performing said lifting and dropping of said ferrous metal components.

18. The method of claim 17 further comprising, subsequent to step (b), the step of cleaning the surface of said ferrous metal components.

* * * * *